United States Patent [19]

Klenk et al.

[11] 4,245,832

[45] Jan. 20, 1981

[54] APPARATUS FOR THE STACKING OF SHEETS

[75] Inventors: Emil Klenk; Karl-Fritz Heina, both of Murrhardt, Fed. Rep. of Germany

[73] Assignee: Maschinenbau Oppenweiler GmbH, Oppenweiler, Fed. Rep. of Germany

[21] Appl. No.: 902,485

[22] Filed: May 3, 1978

[30] Foreign Application Priority Data

May 12, 1977 [DE] Fed. Rep. of Germany ..... 2721441

[51] Int. Cl.[3] ..... B65H 29/14; B65H 29/66

[52] U.S. Cl. ..... 271/185; 271/202; 271/214

[58] Field of Search ..... 271/184, 185, 177, 178, 271/179, 180, 181, 202, 198, 199, 200, 182, 270, 214, 216, 229, 258, 259, 215, 203, 212; 198/462, 460, 572; 83/88

[56] References Cited

U.S. PATENT DOCUMENTS

| | | | |
|---|---|---|---|
| 1,819,841 | 8/1931 | Hudson | 271/212 UX |
| 2,853,298 | 9/1958 | Faeber | 271/214 X |
| 3,545,595 | 12/1970 | Reist | 198/572 |
| 3,635,463 | 1/1972 | Stobb | 271/185 X |
| 3,653,656 | 4/1972 | Stobb | 271/185 |
| 3,674,258 | 7/1972 | Maier et al. | 271/200 X |

FOREIGN PATENT DOCUMENTS

| | | | |
|---|---|---|---|
| 574861 | 4/1976 | Switzerland | 271/181 |

*Primary Examiner*—Bruce H. Stoner, Jr.
*Attorney, Agent, or Firm*—Martin A. Farber

[57] ABSTRACT

An apparatus for the stacking of sheets, with a stacking band conveyor, which for both-sided action on a series of scalelike staggered sheets has conveyor belts with conveying surfaces facing each other defining a conveying track therebetween, the latter beginning at its entrance having at least one bend about an axis parallel to the axes of rotation of the conveyor belts and having an exit directed substantially downwardly from above, with a substantially horizontal support on which the exit of the stacking band conveyor is directed and on which the scalelike staggered sheets are pushed together in the staggering succession into a stack with sheets standing substantially vertically on their edges, and with a feeder which feeds the sheets to the entrance of the stacking band conveyor. The bend at the entrance of the stacking band conveyor is convex viewed from above, so that the lagging edge of each sheet fed from the feeder to the entrance to the stacking band conveyor lifts from the feeder. The stacking band conveyor is driveable with a conveying speed which is so much smaller than the feeding speed of the feeder that the lifted lagging edge of a preceeding sheet is run under by the sheet lagging at a distance on the feeder. A sensor switches off the stacking band conveyor when a following sheet does not run under the lifted lagging edge of the sheet which was picked up by the stacking band conveyor.

2 Claims, 1 Drawing Figure

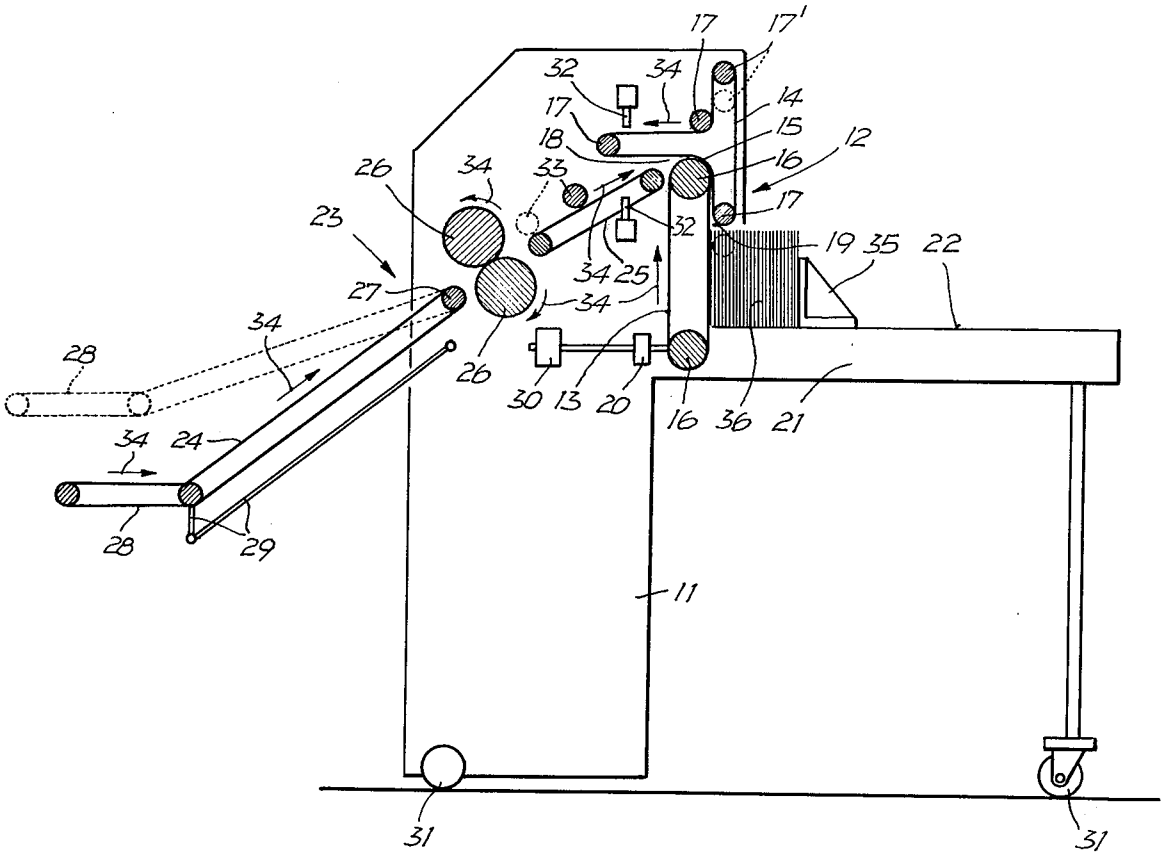
11
12
13
14
15
16
17
17'
18
19
20
21
22
23
24
25
26
27
28
29
30
31
32
33
34
35
36

APPARATUS FOR THE STACKING OF SHEETS

BACKGROUND OF THE INVENTION

1. Field of the Invention

The invention relates to an apparatus for the stacking of sheets with a stacking band conveyor, which for two-sided action on a series of scalelike staggered sheets has conveyor belts with conveying surfaces facing each other, which conveying surfaces define a conveying track, the latter beginning at its entrance having at least one bend about an axis parallel to the axes of rotation of the conveyor belts and having an exit directed substantially downwardly from above, with a substantially horizontal support on which the exit of the stacking band conveyor is directed and on which the scalelike staggered sheets are pushed together in the staggering succession into a stack with sheets standing substantially vertically on their edges, and with a feeder which feeds the sheets to the entrance of the stacking band conveyor.

2. Description of the Prior Art

By devices of this type, stacks are supposed to be formed with sheets vertically standing on one edge, whereby under the designation "sheets", flat objects in general are to be understood, for example, single or individual sheets of paper, cardboard or the like, and multiple folded sheets. The preferred use is the stacking of folded sheets exiting from a folding machine, thus booklets of sheets. The advantage of stacks with vertical standing sheets, which stacks are formed from devices of this type, resides in that this type of stacks by a simple displacement on a table plate can be fed to a further handling device or operation, for example to a bundling or bailing press, where the stacks can be pressed into larger packets and bound together. This has the advantage that the individual packets only need to be taken away in longer time periods.

A device of this type is known from German GBM No. 76 18 803. With this known device the scalelike staggering of the sheets is obtained in the manner that the sheets exiting from a preceeding machine, for example from a printing machine or a folding machine are fed to a slower rotating conveyor belt, so that respectively the lagging edge of a sheet which is located on the conveyor belt is run over by the leading edge of a sheet following from the preceeding machine. If yet a thus staggered sheet series transfers to a stacking band conveyor acting on both sides on it, then this can only produce a stack with vertically standing sheets which stack grows in a direction opposite to the feeding direction. The support on which the stack is produced must thus extend in a direction opposite to the feeding direction of the feeder at least as far as the desired stack is supposed to be long. The distance resulting thereby between the entrance of the stacking band conveyor and the exit of the preceeding machine must thus be bridged over by the feeder. In this manner a comparatively longer feeder is the result, which means a considerable construction expense.

A further disadvantage of the known device is that in order not to make the support (which extends toward the feed direction) still longer, the bundle press which presses the stack together into a bundle must not be arranged in the growing or increasing direction of the stack behind the stack, but rather must be arranged adjacent to this. This causes particular disadvantages when from the bases of rationalization or efficiency, two or more series of sheets are supposed to be fed and stacked side by side from one machine connected in front.

The large length of the feeder required by the known device moreover has the disadvantage that this requires a comparatively heavy frame. If thus the feeder is supposed to be constructed for the height adjustment to the outlet of a preceeding machine, this height adjustment can only be carried out in a comparatively complicated manner.

It is a task on which the invention is based to make a device for stacking of vertically standing sheets, with which the stack increases in the direction in which the sheets run into the device from a preceeding machine, so that devices for further handling of the stack, for example a bundle press, can be arranged in the feed or supply direction seen behind the stacking device. In this manner also the difficulties are avoided which arise with the stacking of several series of sheets running side by side with the known device.

SUMMARY OF THE INVENTION

With a device of the introductory-mentioned type, this task is solved in accordance with the invention in the manner, that the bending at the entrance (18) of the stacking band conveyor (12) is convex viewed from above, so that the lagging edge of each sheet which is fed from the feeder to the entrance to the stacking band conveyor lifts from the feeder, that the stacking band conveyor is driveable with a conveyor speed which is so much smaller than the feeding speed of the feeder that the lifted lagging edge of a preceeding sheet is run under by the sheet lagging at a distance on the feeder, and that a sensor (32) is provided which switches off the stacking band conveyor when the lifted lagging edge of the preceding sheet which was picked up by the stacking band conveyor is not run under by a following sheet i.e., when the sensor senses a space behind this preceding sheet.

The invention thus makes possible the strived for stacking in the feed direction. The feeder consequently can be constructed comparatively short. Therefore there results a feeder with a comparatively light frame. Moreover this has the advantage that the feeder can be formed, for example, as a band conveyor which is pivotable about a horizontal axis, by which the adjustment to the height of the output of a preceeding machine is extremely easy. The easy or light manner of construction of the feeder makes it possible to also provide it with a charging table, which is then adjustable in height together with the feeder.

If the apparatus in accordance with the present invention is used for the stacking or piling of folded sheets, then it is desired to press the sheets together in a pressing roller pair before the stacking. With the introductory-named known device however it is only possible to arrange the pressing roller pair in front of the feeder, since the sheets which are staggered scalelike on the feeder cannot be allowed through the pressing roller pair. If one consequently wants to form the entrance of the apparatus adjustable in height, one must form not only the feeder with its comparatively heavy frame adjustable in height, but simultaneously must also form the pressing roller pair adjustable in height. The difficulties arising thereby are eliminated with the apparatus in accordance with the present invention, since here the feeder conveys the sheets singly in a non-staggered series spaced apart one behind the other. This provides the possibility to produce the feeder with two band conveyors arranged one behind the other and with a pressing roller pair arranged between these two band conveyors. In this manner only the band conveyor which is arranged in front of the pressing roller pair needs to be pivotally mounted for the height adjustment, so that in this manner the height adjustable part of the machine is reduced to a minimum, and consequently the height adjustability can be carried out very easily.

BRIEF DESCRIPTION OF DRAWING

With the above and other objects and advantages in view, the present invention will become more clearly understood in connection with the following detailed description of a preferred embodiment, when considered with the accompanying drawings, of which the only FIGURE is a schematically simplified side view of an embodiment of the invention.

DESCRIPTION OF PREFERRED EMBODIMENT

In a machine support 11 there is provided a stacking conveyor designated as an entity with the numeral 12, which has conveyor belts 13 and 14 with conveyor surfaces facing each other, which conveyor surfaces define a conveying track or path 15. The conveyor belts 13 are guided about guide pulleys 16 and the conveyor belts 14 are guided about guide pulleys 17 and 17', such that the conveying track or path 15 starting at its entrance 18 immediately downstream thereof undergoes a bend about an axis parallel to the axes of rotation of the conveyor belts, and indeed at the entrance from substantially a horizontal direction into a direction which is directed substantially vertically downwardly toward the exit 19.

A table 21, constituting a horizontal support, is arranged spaced under the exit 19 of the conveying track 15, the table surface 22 of which is horizontal and consequently extends substantially perpendicularly to the feed direction of the conveying track 15 at its exit 19. This table 21 is made of individual strips or bars arranged one behind the other in the drawing. The conveyor belts 13 are guided through the intermediate spaces of these bars.

Moreover, a feeder is mounted in the machine support 11, which feeder is designated as an entity with the numeral 23. The feeder 23 has two successively arranged band conveyors 24 and 25, between which there is arranged a pressing roller pair 26. The band conveyor 24 is pivotally mounted in the machine housing 11 about one of its deflection pulleys 27 and on its free end carries a charging table 28 which also is formed of conveyor belts. By means of a parallelogram lever system 29 known per se, the table 28 is connected with the machine support 11 and with the band conveyor 24. With a locking device (not illustrated in the drawings), the band conveyor 24 can be adjusted and locked for various inclinations. In this manner as a consequence of the parallelogram lever system 29, the charging table 28 is always set in its horizontal position at different heights in order thereby to be able to adjust the machine to the heights of the exits of preceeding machines.

The machine support 11 and the table 21 are mounted on rollers 31, so that the entire device can be moved arbitrarily at will.

Directly in front of the entrance 18 of the conveyor track 15 of the stacking conveyor 12 there is arranged a light gate 32. By this it can be determined if a sheet is found at the entrance 18. The light source and the photocell of this light gate are arranged in an intermediate space between the middle conveyor belts 14 of the stacking conveyor and the conveyor belts of the band conveyor 25. The conveyor belts 13 of the stacking conveyor 12 are connected with the drive 30 of the apparatus by means of an electrically switchable clutch coupling 20. The light gate 32 serves for switching of the coupling. As long as the light beam of the light gate 32 is interrupted by a sheet, the shifting coupling 20 is switched on, i.e. operative to couple the drive 30 to the conveyor belts 13. If the light beam is not interrupted, then the coupling is switched off.

Transportation rollers operating from above are coordinated to the band conveyor 24, the transportation rollers not being illustrated in the drawing, since hereby they concern known units. For the band conveyor 25, a transportation roller 33 is provided, which is adjustable in the conveying direction, and which is adjustable and settable between the solid line and dashed line positions illustrated in the drawing, in order to be able to adjust the apparatus to different format lengths.

During operation, the conveyor belts of the charging table 28, of the band conveyors 24 and 25 and the conveyor belts 13 of the stacking conveyor 12 as well as the pressing rollers 26 rotate in the directions indicated by the arrows 34. Depending upon the thickness of the folded sheets which are fed to the charging table 28, the distances or spacings of the pressing rollers 26 from one another are adjusted. Moreover for adjustment of the stacking conveyor 12 to the corresponding thickness of the folded sheet, the uppermost conveyor pulley 17' is adjusted, which pully 17' is adjustable between the dashed line position and the solid line position illustrated in the drawing. Then the transportation roller 33 is adjusted to the format length of the sheet to be stacked such that the sheet leaves the transportation roller 33 when it is picked up by the stacking conveyor 12 at the entrance 18 of the stacking conveyor 12.

The feeder 23 is adjusted to such a large conveying speed that the sheets which are fed by a preceeding machine are fed onto its conveyor belts with a small spacing one in back of the other, thus without overlapping. Then each sheet is singly separately compressed between the pressing rollers 26 and is fed by the band conveyor 25 to the stacking conveyor 12. As soon as the stacking conveyor 12 has picked up the sheet, its front end is bent and turned by the convex (as seen from above) bend at the entrance 18 of the conveyor path 15, so that its rear edge lifts off from the conveyor belts 25 of the feeder 23. The conveyor belts 13 of the stacking conveyor 12 are driven with a speed which is less than the feeding speed of the feeder 23, so that the sheet which is picked up by the stacking conveyor 12 is immediately braked. This has the consequence that the sheet which follows on the band conveyor 25 runs underneath the lagging edge of the sheet which was picked up by the stacking conveyor 12, and both sheets overlappingly run in the stacking conveyor 12. In this way, in the stacking conveyor there is obtained a succession of scalelike staggered sheets, by which, respectively, the rear edge of the leading sheet is run under by the front edge of the lagging sheet.

An abutment 35 is displaceably arranged on the table surface 22 directly adjacent the conveyor belts 13, yet leaving a space free therebetween for the first sheet. During leaving from the exit 19 of the stacking conveyor 12, the sheet which was conveyed by the latter is introduced into this intermediate space between the conveyor belts 13 and the abutment 35 until it lies with its back on the table surface 22. In this manner as soon as the first sheet comes to a stop, the second sheet pushes and slides directly adjacent the conveyor belts 13 under the first sheet, and in this manner displaces the abutment 35 a little bit. In this manner by a successive pushing under, a stack 36 is produced with vertically standing sheets.

If the feeder 24, 25 does not feed a sheet in the proper time such that it can run under the preceeding sheet, then the light beam of the light gate 32 senses a space is no longer interrupted by a sheet, so that the light gate 32 indicates the absence of a properly timed following sheet and the coupling 20 for the drive of the conveyor belts 13 of the stacking conveyor 12 switches off or decouples the drive 30 from the conveyor belts 13, so that the latter stop moving. In this manner the last sheet picked up by the stacking conveyor 12 with its swung-up lagging edge comes to a stop. As soon as a next sheet again interrupts the light beam of the light gate 32, then the coupling 20 switches on and operatively couples the drive 30 with conveyor belts 13 and the latter are again driven and the above-described operation continues.

From the above description it is evident that by the convex bend of the feed track 15 at the entrance 18 of the stacking conveyor 12, there is obtained a scalelike sheet on sheet staggering of the sheets, by which each sheet respectively following the leading sheet runs under the latter. Moreover, by this staggering a series of sheets which are fed to the charging table 28 are stacked on the table 21 in the feeding direction, so that additional apparatus for handling or treating of the stack can be arranged in the same direction behind the above-described apparatus. Also the feeder 23 can be limited to the minimum length required for the connection between the charging table 28 and the entrance 18 of the stacking conveyor 12. In the manner that the feeder 23 conveys non-staggered sheets, thus sheets successively spaced one behind the other, it can also be provided with the pressing roller pair 26, so that it can be formed from two successively arranged band conveyors 24 and 25, whereby the band conveyor 24 which is pivotally mounted for the height adjustment furthermore can be reduced to a minimum length, which considerably simplifies the devices for the height adjustment.

We claim:

1. An apparatus for successively feeding sheets to a rear end of a stack of sheets standing upright on their edges, comprising a first conveyor means, a second conveyor means downstream of the first conveyor means, support means for supporting the stack of sheets leaving said second conveyor means, said first conveyor means being adapted for a first conveying speed and having an exit and first engaging means for engaging the sheets, said first engaging means forming an upwardly inclined first conveying path, said first engaging means has an end portion including an uppermost end adjacent to said exit, said first engaging means including a bottom engaging conveyor for engaging only lower sides of said sheets at least within said end portion, said end portion constituting means thereby for only engaging the lower sides of said sheets, said first conveyor means for conveying the sheets to said exit in an upwardly inclined first feeding direction, said second conveyor means being adapted for a second conveying speed and having second engaging means for engaging both sides of the sheets and having an entrance to said second engaging means laterally downstream closely adjacent to but slightly higher than said exit of said first conveyor means, said first engaging means includes an upper engaging means for engaging upper sides of said sheets in a portion of said first conveying path upstream of said end portion, said upper engaging means is displaceably adjustably positioned along said first conveyor means such that the distance between said upper engaging means and said second engaging means is substantially equal to the length of each of the sheets being fed, respectively, whereby said second engaging means engages a sheet when said sheet leaves said upper engaging means, thereby enabling the apparatus to be adapted to different lengths of sheets to be fed from time to time, said second engaging means forming a perpendicularly bending second conveying path leading horizontally from said entrance of said second conveyor means vertically to said support means for feeding the sheets to the rear end of the stack of sheets, said second conveying path being bent from a horizontal direction vertically downwardly immediately downstream of said entrance leading vertically to the rear end of the stack of sheets, said second conveying path defining a horizontal second feeding direction of the sheets at said entrance and a vertical third feeding direction of the sheets vertically adjacent and at the rear end of the stack of sheets so that the sheets are fed from the horizontal second feeding direction at said entrance into the vertical third feeding direction at the rear end of the stack, said second conveyor means has a horizontally extending portion which extends substantially in an upstream direction beyond both said entrance of the second conveyor means and said exit of said first conveyor means and is spaced above said end portion of said first engaging means, said first feeding direction being directed toward a lower side of said horizontally extending portion of said second conveyor means at said entrance and forming an acute angle with said horizontal second feeding direction so that at said end portion of said first engaging means a trailing edge of each sheet which is engaged at a leading edge by said second engaging means is released from said first engaging means and lifts from said end portion of said first engaging means toward said horizontally extending portion spaced thereabove, said second engaging means comprises a first conveyor belt fully vertically disposed and having a vertical surface abutting the entire rear end of the stack of sheets and extending therebelow, and a second conveyor belt having a course in the shape of a T with the T oriented sidewise and disposed over and against an uppermost portion of said first conveyor belt, means for driving said first conveyor belt with a second conveying speed slower than that of said first conveyor means, an electrically switchable coupling operatively disposed between said driving means and said first conveyor belt, said first conveyor belt including only two guide pulleys comprising a lowermost guide pulley disposed lower than the stack of sheets and a first guide pulley vertically above said lowermost guide pulley, said first guide pulley defining said uppermost portion of said first conveyor belt, said uppermost portion of said first conveyor belt is disposed between and pressingly against a horizontal leg of the T and a vertically downwardly extending side of a top of the T cooperatively defining said second engaging means for engaging both sides of the sheets thereat, three second guide pulleys disposed inside said second conveyor belt at three extremities of the T, respectively, an uppermost of said second guide pulleys is vertically displaceable, the vertically downwardly extending side of the top of the T being parallel and adjacent to a substantial portion of the length of an upper portion of said vertical surface of said first conveyor belt and cooperatively defining said vertical third feeding direction directly above the rear end of the stack of sheets, said horizontal leg of the T constitutes said horizontally extending portion of said second conveyor means, said first guide pulley and said uppermost portion of said first conveyor belt press against a substantially small portion of the total length of said second conveyor belt between said other two of said second guide pulleys, said first guide pulley defining an immediate sharp bend of said second engaging means from said horizontal second feeding direction to said vertical third feeding direction, said uppermost portion of said first conveyor belt and a center of said first guide pulley are disposed above an imaginary line drawn between said other two of said second guide pulleys yet substantially linearly therebetween, another guide pulley is disposed outside said second conveyor belt spaced substantially vertically above said uppermost portion of said first conveyor belt pressingly against said second conveyor belt between said horizontal leg of the T and an upwardly extending side of the top of the T, said uppermost portion of said first conveyor belt is spaced slightly apart laterally from but closely adjacent to and slightly above said uppermost end of said end portion of said first engaging means of said first conveyor means, the first conveying speed of said first conveyor means being so much faster than the second conveying speed of said second conveyor means that the lifted said trailing edge of a preceeding sheet engaged only by said second engaging means is run under by a leading edge of a following sheet while the latter sheet is engaged by said first engaging means, thereby causing successive of said sheets to overlap sequentially within said second conveyor means, sensor means for sensing a space behind a trailing edge of a sheet engaged by said second engaging means of said second conveyor means, said sensor means is disposed adjacent said end portion of said first engaging means of said first conveyor means directly upstream of said entrance and exit, said sensor means for switching off said switchable coupling and said second conveyor means as long as the leading edge of a following sheet is not under the trailing edge of the preceeding sheet engaged by said second engaging means, a movable machine support, said first and second conveyor means, said driving means, said switchable coupling, said sensor means and said support means are operatively mounted on said machine support, a band conveyor operatively disposed upstream of said first conveyor means is pivotal at a downstream end thereof to said machine support about a horizontal axis, said band conveyor includes an input charging table which is adjustable in height and extends beyond said movable machine support, and a pressing roller pair is arranged on said machine support between said downstream end of said band conveyor and said first conveyor means.

2. The apparatus according to claim 1, wherein said upper engaging means of said first engaging means is a roller.

* * * * *